United States Patent [19]

Kuwabara et al.

[11] Patent Number: 4,711,287

[45] Date of Patent: Dec. 8, 1987

[54] CASTING METHOD

[75] Inventors: Hideki Kuwabara, Hadano; Masato Naitō, Hiratsuka; Teishiro Watanabe; Tadatsugu Hamada, both of Hiroshima, all of Japan

[73] Assignees: Mitsubishi Jukogyo Kabushiki Kaisha; Japan Styrene Paper Corporation, both of Tokyo, Japan

[21] Appl. No.: 830,730

[22] Filed: Feb. 19, 1986

[30] Foreign Application Priority Data

| | | | |
|---|---|---|---|
| Feb. 27, 1985 | [JP] | Japan | 60-38511 |
| Feb. 28, 1985 | [JP] | Japan | 60-39873 |
| Mar. 19, 1985 | [JP] | Japan | 60-53310 |
| Mar. 19, 1985 | [JP] | Japan | 60-53311 |

[51] Int. Cl.[4] ..... B22C 7/02; B22C 9/04

[52] U.S. Cl. ..... 164/34; 164/45; 164/246

[58] Field of Search ..... 164/34, 35, 36, 45, 164/246

[56] References Cited

U.S. PATENT DOCUMENTS

| | | | |
|---|---|---|---|
| 3,339,620 | 9/1967 | Krzyzanowski et al. | 164/34 X |
| 3,374,824 | 3/1968 | Snelling | 164/34 |
| 3,426,834 | 2/1969 | Jacobs et al. | 164/246 X |
| 4,291,739 | 9/1981 | Baur | 164/34 X |

FOREIGN PATENT DOCUMENTS

| | | | |
|---|---|---|---|
| 627229 | 7/1963 | Belgium | 164/34 |
| 1239437 | 4/1967 | Fed. Rep. of Germany | 164/34 |
| 2758993 | 7/1979 | Fed. Rep. of Germany . | |
| 1332924 | 3/1964 | France | 164/34 |
| 55-77959 | 6/1980 | Japan | 164/34 |

OTHER PUBLICATIONS

*Fonderie,* No. 36, Jun.-Jul. 1984, pp. 44–47.

*Metallurgical Science and Technology,* Jun. 1983, pp. 14–31.

*Primary Examiner*—M. Jordan

*Assistant Examiner*—J. Reed Batten, Jr.

*Attorney, Agent, or Firm*—Stephen F. K. Yee

[57] ABSTRACT

A consumable pattern of an expanded polyolefin resin and a bulk density of 0.025–0.012 g/cm$^3$ is embedded in a mold body, a gating system leading to the pattern is formed in the mold body, and molten metal is poured into the gating system to volatilize and replace the pattern. The polyolefin resin is selected from noncrosslinked polypropylene resins, crosslinked polypropylene resins, crosslinked high-density polyethylene and mixtures thereof.

10 Claims, 7 Drawing Figures

CASTING METHOD

BACKGROUND OF THE INVENTION

This invention relates generally to a casting method and, more specifically, to an improved full mold casting method using a consumable pattern which in shape is an exact replica of the intended casting and which is vaporized and displaced by a molten metal charge.

There is known a full mold casting method including the steps of surrounding a consumable pattern formed of an expanded plastic material with particulate refractory material, vaporizing the pattern by contacting the pattern with molten metal, and filling the resulting cavity with the molten metal. As the consumable patterns, those formed of expanded polystyrene resins have been conventionally used. Because of the presence of benzene rings having a relatively high bond dissociation energy, however, the polystyrene resins are incapable of being perfectly decomposed and volatilized and have a tendency to leave a residue. The residue from incompletely destroyed pattern causes surface defects such as dirt, carbon deposit, wrinkles and roughness, and inside defects such as carburization. Therefore, the resulting castings having such defects require additional surface finishing works or must be rejected.

The present invention has been made with a consideration of the above-described problems encountered in the conventional full mold casting method.

SUMMARY OF THE INVENTION

In accordance with the present invention there is provided a method of casting, comprising the steps of:

providing a pattern formed of an expanded polyolefin resin having a density of 0.025–0.012 g/cm$^3$, said polyolefin resin being selected from the group consisting of non-crosslinked polypropylene resins, crosslinked polypropylene resins, crosslinked high density polyethylenes and mixtures thereof;

embedding said pattern in a mold body;

forming in said mold body a gating system leading to said embedded pattern; and pouring into said gating system molten metal for volatilizing and replacing said embedded pattern in said mold body.

BRIEF DESCRIPTION OF THE DRAWINGS

The present invention will now be described in detail below with reference to the accompanying drawings in which.

DETAILED DESCRIPTION OF THE DRAWINGS

Figure 1:
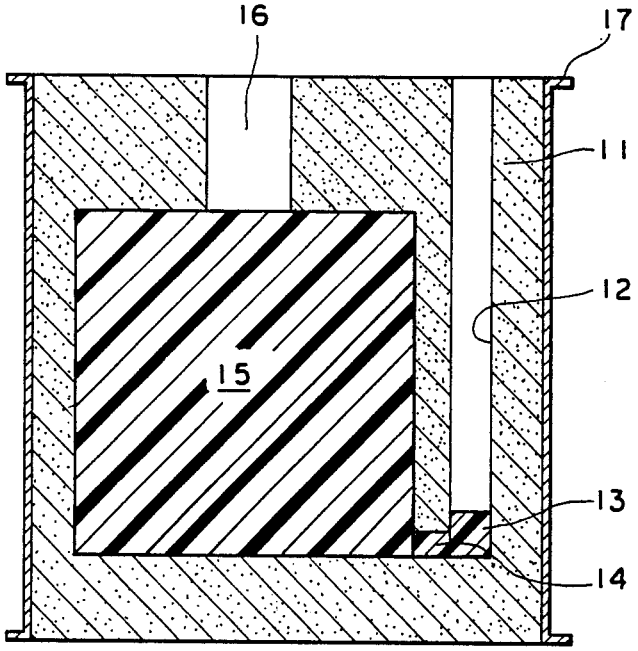
FIG. 1 is a vertical cross-section diagrammatically showing one embodiment of a mold used for carrying out the method according to the present invention.

One of the features of the present invention resides in the use of a pattern formed of a specific expanded polyolefin resin in a full mold casting method. The polyolefin resin is selected from non-crosslinked polypropylene resins, crosslinked polypropylene resins and high density polyethylenes. Preferred polyolefin resins will be described hereinbelow.

(1) The non-crosslinked polypropylene resin may be, for example, a propylene homopolymer, an ethylene-propylene random copolymer, an ethylene-propylene block copolymer, a propylene-1-butene random copolymer and a mixture of two or more of the above. Above all, the use of an ethylene-propylene random copolymer having an ethylene content of 0.5–10 weight % is particularly preferred.

The pattern used in the method of the present invention may be prepared, for example, by providing unexpanded particles of the above non-crosslinked polypropylene resin, expanding the unexpanded particles to obtain pre-expanded particles, and further expanding the pre-expanded particles within a mold. The pre-expansion of the unexpanded particles may be performed, for example, by impregnating the unexpanded particles with a blowing agent, dispersing the resulting particles in water within a closed vessel together with a fine particulate adhesion-preventing agent, heating the dispersion under a pressure to a temperature higher than the softening point of the unexpanded particles, and subjecting the dispersion to a decreased pressure so that the unexpanded particles are expanded. Examples of the blowing agents are organic blowing agents such as propane, butane, pentane, trichlorofluoromethane and dichlorodifluoromethane, and inorganic blowing agents such as carbon dioxide, nitrogen and air. The adhesion-preventing agent may be, for example, aluminum oxide, titanium oxide, aluminum hydroxide, basic magnesium carbonate, basic zinc carbonate and zinc carbonate.

The thus obtained pre-expanded particles of non-crosslinked polypropylene resin are then filled in a mold and heated to further expand same therewithin thereby to obtain a pattern of the expanded, non-crosslinked polypropylene resin. In this case, the expansion within a mold should be conducted so that the resulting pattern has a density of 0.025–0.012 g/cm$^3$, preferably 0.024–0.014 g/cm$^3$. If the density of the pattern becomes less than 0.012 g/cm$^3$, it may lack adequate strength to withstand ordinary molding pressure and other stress. On the other hand, a density of the pattern in excess of 0.025 g/cm$^3$ causes the production of so large a volume of decomposed gas upon contact with molten metal that the molten metal flows backward through the gating system and spouts out from the sprue, an occurrence commonly known as a "blow".

It is preferred that each of the expanded particles constituting the pattern have a particle size of 10 mm or less because otherwise the surface of the pattern becomes roughened or undulated. It is also preferred that each of the pores(cells) of the pattern have a size of 0.1–1 mm. If the pore size is above 1 mm, the surface of the pattern becomes roughened. Too small a pore size will cause a reduction in mechanical strength of the pattern. It is further preferred that the pattern of an expanded, non-crosslinked polypropylene resin have secondary crystals for reasons of ensuring excellent physical properties suitable for full mold casting such as compressive hardness, compression set and ability of absorbing water. The pattern containing secondary crystals of non-crosslinked polypropylene resin may be obtained from pre-expanded particles containing secondary crystals of the polypropylene resin. The secondary crystals are formed when the non-crosslinked polypropylene resin is subjected to a temperature between its melting point and a melt-completion temperature (secondary crystals-forming temperature region). Thus, the pre-expanded particles with secondary crystals of a polypropylene resin can be obtained by expanding unexpanded particles at a temperature within the secondary crystals-forming temperature region. When the pre-expansion of unexpanded particles is performed at a temperature higher than the melt-completion temperature, it is important that the unexpanded particles should be previously maintained at the secondary crystals-forming temperature region for a period of time so that the secondary crystals can form sufficiently in a large amount. By this, even when the unexpanded particles are heated to an expansion temperature higher than the melt-completion temperature, the expanded particles obtained still contain a quantity of the secondary crystals which remain undestroyed during the expansion step.

Whether or not the expanded particles contain the secondary crystals can be tested by differential scanning calorimetry (DSC) techniques. For this purpose, the polypropylene resin particles (1 to 3 mg) are heated at a rate of 10° C./min to 220° C. using a differential scanning calorimeter while measuring the temperature of the sample and the calorific value required for heating the sample. The results are plotted with the temperature as abscissa and the differential heat as ordinate to give a curve (first DSC curve). The heated sample is then cooled at a rate of 10° C./min to about 40° C. Thereafter, the sample is again heated in the same manner as in the first heating stage as mentioned above to give a second DSC curve. Each of the first and second DSC curves has a peak (characteristic peak) which is indicative of the absorption of heat during the melting of the resin and which is characteristic to the resin. The temperatures at the characteristic peaks in the first and second DSC curves may be the same or different from each other. The difference is below 5° C., generally below 2° C., however. In addition to the characteristic peak there may be a second peak (high temperature peak) in the first DSC curve at a temperature higher than that of the characteristic peak. The high temperature peak is attributed to the absorption of heat for the destruction of the secondary crystals. Thus, the existence or non-existence of the secondary crystals can be seen from the presence or absence of the high temperature peak. That is, if the first DSC curve shows substantially no high temperature peak, then the sample is regarded as containing substantially no secondary crystals. The second DSC curve shows no high temperature peak because the secondary crystals if any have been destroyed during the first heating stage. It is preferred that the difference in temperature between the high temperature peak and characteristic peak of the second DSC curve be great because the greater the difference the more stable are the secondary crystals. The difference is preferably over 5° C., more preferably over 10° C.

Figure 5:
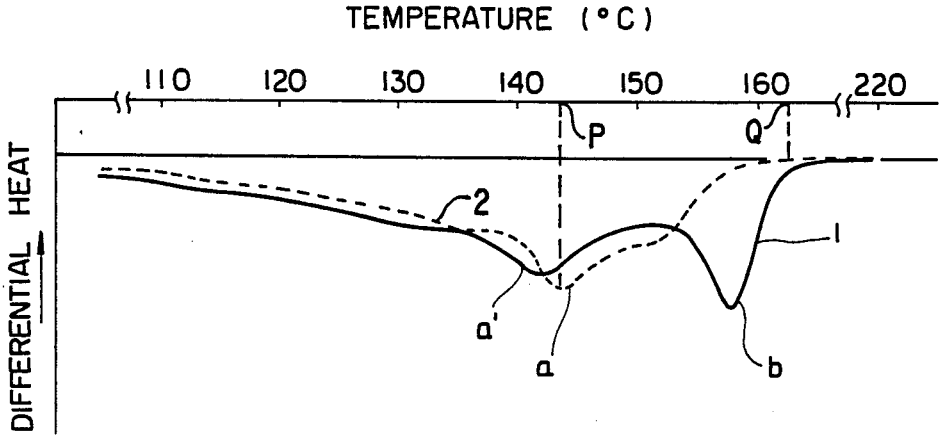
FIG. 5 is a DSC curve obtained by a differential scanning calorimetric analysis of a pattern formed of an expanded polypropylene resin having a secondary structure.

A typical example of DSC curve is shown in FIG. 5, in which designated as 1 and 2 are first and second DSC curves, respectively. The peak a and a' represent characteristic peaks, while the peak b represents a high temperature peak. The point P at which the second DSC curve 2 becomes maximum is the melting point of the resin and the point Q at which the second DSC curve 2 reaches the base line represents the melt-completion temperature.

(2) The crosslinked polypropylene resin is a resin obtained by crosslinking a polypropylene resin such as a propylene homopolymer, an ethylene-propylene random copolymer, an ethylene-propylene block copolymer, a propylene-1-butene random copolymer and a mixture of two or more of the above. Above all, the use of an ethylene-propylene random copolymer having an ethylene content of 1–10 weight % and a n-heptane insoluble content of not greater than 50 weight % is particularly preferred. The term "n-heptane insoluble content" used herein is defined by the equation shown below and represents stereoregularity of the resin:

$$R\ (\%) = (A/B) \times 100$$

wherein R stands for n-heptane insoluble content, A stands for the weight of unextracted residues remaining after 8 hours extraction with n-heptane and B stands for the weight of the resin before subjecting to the n-hexane extraction.

The pattern used in the method of the present invention may be prepared, for example, by providing unexpanded particles of the above polypropylene resin, crosslinking the unexpanded particles, expanding the crosslinked, unexpanded particles to obtain pre-expanded particles, and further expanding the pre-expanded particles within a mold.

The crosslinked polypropylene resin particles may be suitably obtained by a method including mixing a non-crosslinked polypropylene resin in the form of particles, a crosslinking agent, an adhesion-preventing agent and water to impregnate the resin particles with the crosslinking agent, and heating the resulting mixture to a temperature sufficient to effect the crosslinking. Illustrative of suitable crosslinking agents are 1,1-bis(t-butylperoxy)-3,3,5-trimethylcyclohexane, dicumyl peroxide, t-butylcumyl peroxide, n-butyl-4,4-bis(t-butylperoxy)-valerate and 2,5-dimethyl-2,5-di(t-butylperoxy)hexane. The crosslinking agent is used in an amount of 0.05–5 parts by weight per 100 parts by weight of the resin. The adhesion-preventing agent may be, for example, aluminum oxide, titanium oxide, aluminum hydroxide, basic magnesium carbonate, basic zinc carbonate and zinc carbonate. It is preferable to incorporate divinylbenzene in the dispersion to accelerate the crosslinking. Divinylbenzene is generally used in an amount of 0.05–5 parts by weight per 100 parts by weight of the resin. Preferably, the crosslinking is performed to a degree so that the preexpanded, crosslinked polypropylene resin particles have a gel fraction of 0.01–40%. Pre-expanded particles with a gel fraction of greater than 40% tend to give an expanded pattern having undesirable voids. The term "gel fraction" used herein is defined by the equation shown below and represents a xylene insoluble content of the pre-expanded particles:

$$P\ (\%) = (M/L) \times 100$$

wherein P stands for a gel fraction, M stands for the weight of insoluble residues remaining after immersing the preexpanded, crosslinked polypropylene resin particles in boiling xylene for 8 hours, and L stands for the weight of the resin particles prior to the xylene treatment.

The pre-expansion of the crosslinked, unexpanded particles may be performed, for example, by impregnating the unexpanded particles with a blowing agent, dispersing the blowing agent-containing particles in water within a closed vessel together with a fine particulate adhesion-preventing agent of a type described above, heating the dispersion under a pressure to a temperature higher than the softening point of the resin particles, and subjecting the dispersion to a decreased pressure so that the unexpanded particles are expanded. Examples of the blowing agents are organic blowing agents such as propane, butane, pentane, trichlorofuloromethane and dichlorodifluoromethane, and inorganic blowing agents such as carbon dioxide, nitrogen and air.

The thus obtained expanded particles of crosslinked polypropylene resin are then filled in a mold and heated to further expand same therewithin, thereby to obtain a pattern of the expanded, crosslinked polypropylene resin. Likewise in the case of the production of a pattern formed of a noncrosslinked polypropylene resin described previously, the expansion within a mold should be conducted so that the resulting pattern has a density of 0.025–0.012 g/cm$^3$, preferably 0.024–0.014 g/cm$^3$.

(3) The crosslinked high density polyethylene resin is a resin obtained by crosslinking a high density polyethylene. The high density polyethylene is generally obtained by a low pressure method and preferably has a density of 0.94 g/cm$^3$ or more. The pattern formed of the crosslinked high density polyethylene may be prepared in the same manner as the preparation of patterns formed of crosslinked polypropylene resins described above. Thus, the crosslinking of the unexpanded, high density polyethylene particles, the pre-expansion of the crosslinked, unexpanded particles and the expansion of the pre-expanded particles in a mold may be carried out in the same manner as described above with reference to the crosslinked polypropylene resin.

If desired, patterns formed of a crosslinked high density polyethylene resin and a crosslinked polypropylene resin may be used in the full mold casting method according to the present invention. In this case, a mixture of unexpanded particles formed of a non-crosslinked polypropylene resin and unexpanded particles formed of a non-crosslinked high density polyethylene are suitably used as a starting material for the production of such a pattern. The crosslinking and the pre-expansion of the unexpanded particles and the expansion molding of the pre-expanded particles may be conducted in the same manner as described above.

The pattern used in the method of the present invention may also be prepared from a block of an expanded polyolefin resin of the above-described type by cutting, shaping, bonding and any other necessary processing. Further, the pattern may be produced by using an extrusion technique.

In the method according to the present invention, the pattern formed of the above-described specific polyolefin resin is embedded in a mold body by, for example, surrounding the pattern with molding sand in a flask followed by ramming. At the same time, a passage(gating system) leading to the embedded pattern is formed. Then, molten metal is poured into the sprue of the gating system so that the pattern is decomposed or burned. The cavity formed as a result of the volatilization of the pattern is simultaneously filled with the molten metal. The molten metal substituted for the pattern is then cooled for solidification, thereby to obtain a casting which is identical in shape and in size with the pattern used.

The molding sand is generally a mixture of a refractory material such as silica sand, olivine sand, zircon sand or chromite sand, and a binder. Examples of such molding sand include inorganic molding sand such as green sand, sodium silicate bonded sand and cement bonded sand and organic molding sand such as furan binder sand and cold box process. If desired, a curing agent for setting the binder may be incorporated into the mixture. In some cases, the refractory material is used by itself as the molding sand.

A preferred way of carrying out the method of the present invention is illustrated diagrammatically in FIG. 1, in which the reference numeral 15 designates a pattern formed of the above-described specific polyolefin resin. The pattern 15 is joined by a suitable adhesive with a runner 13 and an ingate 14, both formed of the same polyolefin resin as the pattern, and is placed in position in a flask 17 together with a sprue 12 formed of an earthen pipe. The sprue 12, runner 13 and ingate 14 constitute a gating system for a molten metal charge. A form made of, for example, wood is preferably placed in position for the formation of a vent 16. Then, molding sand 11 is packed in the vessel 17 for surrounding the pattern 15, sprue 12, riser 13, ingate 14 and wooden form by ramming. The form is thereafter withdrawn from the mold, thereby leaving the vent 16 connecting to the upper surface of the pattern 15. Molten metal having a temperature of 1400° C., for example, is then poured into the sprue 12 in a manner well known in the art.

By the provision of the vent 16, the gas produced by the vaporization of the pattern 15 upon contact with the molten metal escapes through the vent, thereby preventing the occurrence of blow.

Figure 2:
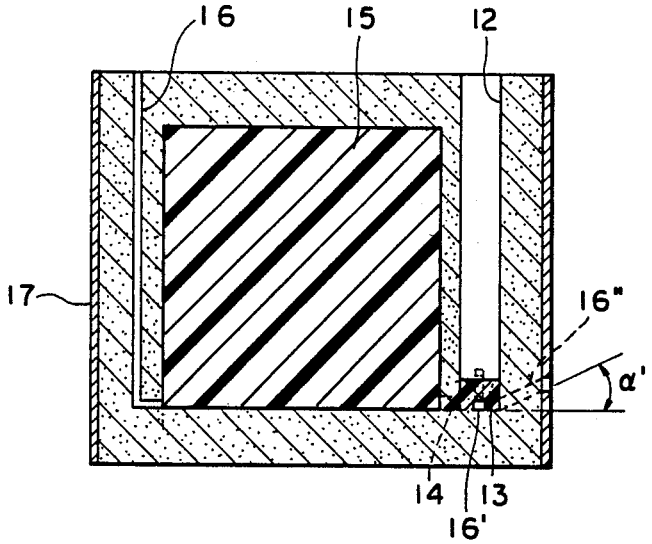
FIG. 2 is a cross-section taken on line II—II of FIG. 3 diagrammatically showing another embodiment of a mold used for carrying out the method of the present invention.
Figure 3:
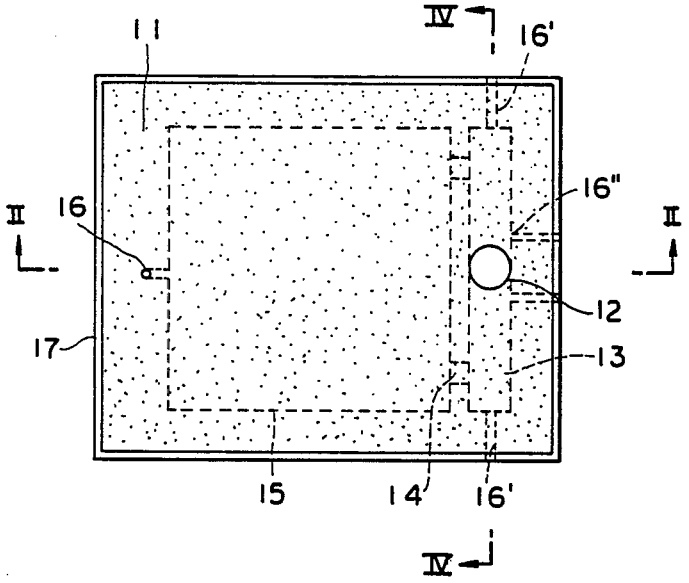
FIG. 3 is a plan view of FIG. 2.
Figure 4:
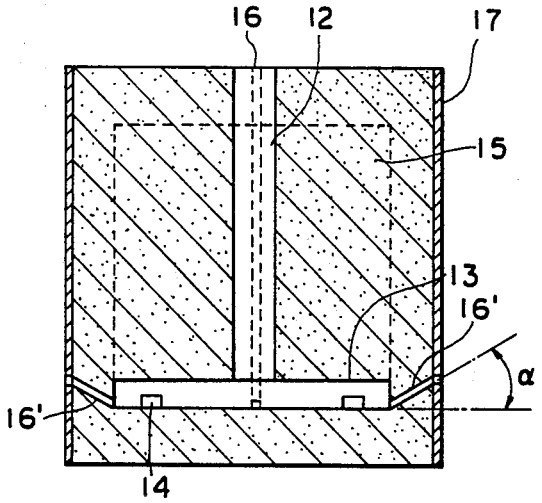
FIG. 4 is a cross-section taken on line IV—IV of FIG. 3.

FIGS. 2 through 4 illustrate diagrammatically another preferred embodiment of a mold, in which like reference numerals designate like components. For simplicity of illustration, the runner 13 and ingate 14 are illustrated as voids, though they are actually formed of a polyolefin resin likewise in the case of the mold of FIG. 1.

The mold shown in FIGS. 2 through 4 differs from that of FIG. 1 in the arrangement of the vent. That is, in this variant, a plurality of vents 16, 16' and 16'' are provided. The vent 16 is formed into an L-shaped passage and is disposed opposite to a gating system including a sprue 12, runner 13 and ingate 14 with its one end opening to the air at the top of the mold and its the other end communicating with the lower portion of the pattern 15. The number and position of the vent 16 are not limited to the above but may be suitably varied with the size, shape and kind of the pattern. A pair of vents 16' are provided in both ends of the runner 13 while a pair of vents 16'' are provided adjacent to the bottom end of the sprue 12. The vents 16' and 16'' extend upwardly slantwise toward the periphery of the mold so as to prevent "run-out" of the molten metal therethrough. The inclination angle ($\alpha$ in FIG. 4 and $\alpha'$ in FIG. 2) of the vents 16' and 16'' is preferably at least 25° with respect to the horizontal plane. The number, sectional area and location of the vents 16' and 16'' are suitably determined according to the shape and properties of the consumable pattern. It is advisable to provide vents at locations (such as pockets) where blow is liable to occur. It is generally sufficient that either one of the vents 16' and 16'' be provided together with the vent 16.

The mold shown in FIGS. 2–4 may be prepared in the same manner as described above with reference to the mold of FIG. 1. The vents 16, 16' and 16'' may be formed by placing appropriate forms, such as wooden forms, in the mold and withdrawing same after the packing of molding sand but generally before the completion of the curing thereof. If necessary, the vents 16' and 16'' are closed as soon as the discharge from the mold of the decomposition gas initially produced upon contact of the polyolefin forms with the molten metal is completed.

The following examples will illustrate further the present invention. In the examples, "%" and "part" are by weight except otherwise specifically noted.

EXAMPLE 1

100 parts of unexpanded particles formed of an ethylene-propylene random copolymer having an ethylene content of 2.5%, 300 parts of water, 0.3 part of finely divided aluminum hydroxide and 18 parts of dichlorodifluoromethane were mixed in an autoclave to form a dispersion. The dispersion was heated to 140° C. with stirring and maintained at that temperature for 30 min. Thereafter, the dispersion was heated to 143° C. and maintained at that temperature for 15 min. Compressed air was then introduced into the autoclave to raise the pressure therewithin to 40 $Kg/cm^2G$. The autoclave was released to discharge the dispersion therefrom, thereby obtaining primarily pre-expanded particles. The primarily pre-expanded particles were then exposed to pressurized air for pressure-charging the air into the cells of the pre-expanded particles. The air-charged particles were heated with steam of 1.3 $Kg/cm^2G$ and allowed to expand, thereby obtaining secondarily pre-expanded particles. The thus obtained pre-expanded particles were charged in a vessel and held in pressurized air of 2 $Kg/cm^2G$ for 2 days. The resultant pre-expanded particles, which had a pressure within the cells of 1.0–1.5 $Kg/cm^2G$, were filled in a mold cavity and heated with steam of 3.5 $Kg/cm^2G$, so that the secondarily pre-expanded particles were expanded and integrally bonded with each other within the mold. The resulting molded product had a density of 0.015 $g/cm^3$ and a pore size (cell size) of 0.5 mm and was found to contain secondary crystals.

EXAMPLE 2

Example 1 was repeated in the same manner as described except that as the unexpanded particles of an ethylene-propylene random copolymer, those having an ethylene content of 3.5% were used. The resulting molded product had a density of 0.020 $g/cm^3$ and a pore size of 0.8 mm and was found to contain secondary crystals.

EXAMPLE 3

Example 1 was repeated in the same manner as described except that as the unexpanded particles of an ethylene-propylene random copolymer, those having an ethylene content of 4.2% were used. The resulting molded product had a density of 0.024 $g/cm^3$ and a pore size of 0.2 mm and was found to contain secondary crystals.

COMPARATIVE EXAMPLE 1

Example 2 was repeated in the same manner as described with the exception that the expansion molding was conducted so that the resulting molded product had a density of 0.010 $g/cm^3$ and a pore size of 0.6 mm. The molded product was found to contain secondary crystals.

COMPARATIVE EXAMPLE 2

Example 1 was repeated in the same manner as described with the exception that the expansion molding was conducted so that the resulting molded product had a density of 0.026 $g/cm^3$ and a pore size of 0.3 mm. The molded product was found to contain secondary crystals.

EXAMPLE 4

100 parts of unexpanded particles formed of an ethylene-propylene random copolymer having an ethylene content of 3.8% and a n-heptane insoluble content of 5%, 300 parts of water, 0.3 part of finely divided aluminum hydroxide, 0.30 part of 1,1-bis(t-butylperoxy)-3,4,5-trimethylcyclohexane and 0.3 part of divinylbenzene were mixed and heated to 100° C. in an autoclave with stirring and maintained at that temperature for 1 hour. The resulting dispersion was then heated to 150° C. to effect crosslinking of the copolymer. The crosslinked particles were recovered after cooling the autoclave. 100 parts of the thus obtained crosslinked particles, 300 parts of water, 0.3 part of finely divided aluminum hydroxide and 18 parts of dichlorodifluoromethane were mixed in an autoclave with stirring to obtain a dispersion. The dispersion was then heated to 150° C. and maintained at that temperature for 15 min. Compressed air was charged within the autoclave to raise the pressure therewithin to 40 $Kg/cm^2G$. Then the autoclave was released for discharging the dispersion therefrom while maintaining the pressure therewithin at 40 $Kg/cm^2G$, whereby the crosslinked particles were expanded. The thus obtained pre-expanded particles were placed in a vessel and held in the atmosphere of pressurized air so that the pressure within the cells of the pre-expanded particles rose to 1.5 $Kg/cm^2G$. The resultant pre-expanded particles were filled in mold cavity and heated with steam of 3.2 $Kg/cm^2G$, whereby the pre-expanded particles were expanded and integrally bonded with each other within the mold to obtain a molded product having a density of 0.022 $g/cm^3$ and a gel fraction of 30.

EXAMPLE 5

Example 4 was repeated in the same manner as described except that as the unexpanded particles of an ethylene-propylene random copolymer those having an ethylene content of 2.8% and n-heptane insoluble content of 28% were used and that the crosslinking agent, divinylbenzene and dichlorodifluoromethane were used in amounts of 0.35 part, 0.35 part and 19 parts, respectively, thereby obtaining a molded product having a density of 0.018 $g/cm^3$ and a gel fraction of 35.

EXAMPLE 6

Example 4 was repeated in the same manner as described except that as the unexpanded particles of an ethylene-propylene random copolymer those having an ethylene content of 1.5% and n-heptane insoluble content of 40% were used and that the crosslinking agent, divinylbenzene and dichlorodifluoromethane were used in amounts of 0.25, 0.25 and 20 parts, respectively, thereby obtaining a molded product having a density of 0.015 g/cm$^3$ and a gel fraction of 20.

EXAMPLE 7

100 parts of unexpanded particles of a high density polyethylene having a density of 0.958 g/cm$^3$ and a melt index (MI) of 0.40, 300 parts of water, 0.3 part of finely divided aluminum hydroxide and 0.32 part of dicumylperoxide were mixed and heated to 100° C. in an autoclave with stirring and maintained at that temperature for 1 hour. The resulting dispersion was then heated to 150° C. to effect crosslinking of the copolymer for 90 min. The crosslinked particles were recovered after cooling the autoclave. 100 parts of the thus obtained cross-linked particles, 300 parts of water, 0.3 part of finely divided aluminum hydroxide and 28 parts of dichlorodifluoromethane were mixed in an autoclave with stirring to obtain a dispersion. The dispersion was then heated to 150° C. and maintained at that temperature for 15 min. Compressed air was charged within the autoclave to raise the pressure therewithin to 40 Kg/cm$^2$G. Then the autoclave was released for discharging the dispersion therefrom while maintaining the pressure therewithin at 40 Kg/cm$^2$G, whereby the crosslinked particles were expanded. The thus obtained pre-expanded particles were placed in a vessel and held in the atmosphere of pressurized air so that the pressure within the cells of the pre-expanded particles rose to 1.5 Kg/cm$^2$G. The resultant pre-expanded particles were filled in a mold cavity and heated with steam of 3.2 Kg/cm$^2$G, whereby the pre-expanded particles were expanded and integrally bonded with each other within the mold to obtain a molded product having a density of 0.019 g/cm$^3$ and a gel fraction of 35.

EXAMPLE 8

Example 7 was repeated in the same manner as described except that as the unexpanded particles of a high density polyethylene those having a density of 0.952 g/cm$^3$ and a melt index of 0.11 were used and that the crosslinking agent and dichlorodifluoromethane were used in amounts of 0.30 part and 25 parts, respectively, thereby obtaining a molded product having a density of 0.024 g/cm$^3$ and a gel fraction of 30.

EXAMPLE 9

Example 7 was repeated in the same manner as described except that as the unexpanded particles of a high density polyethylene those having a density of 0.968 g/cm$^3$ and a melt index of 5.5 were used and that the crosslinking agent and dichlorodifluoromethane were used in amounts of 0.28 part and 30 parts, respectively, thereby obtaining a molded product having a density of 0.014 g/cm$^3$ and a gel fraction of 24.

EXAMPLE 10

Example 4 was repeated in the same manner as described except that as the unexpanded particles a mixture of (1) 30 parts of unexpanded particles of an ethylene-propylene random copolymer having an ethylene content of 2.8% and n-heptane insoluble content of 28% and (2) 70 parts of unexpanded particles of a high density polyethylene having a density of 0.958 g/cm$^3$ and a melt index of 0.4 was used and that 0.35 part of dicumylperoxide was used in place of 1,1-bis(t-butylperoxy)-3,3,5-trimethylcyclohexane and divinyl benzene and dichlorodifuloromethane were used in amounts of 0.35 and 23 parts, respectively, thereby obtaining a molded product having a density of 0.018 g/cm$^3$ and a gel fraction of 28.

EXAMPLE 11

Example 4 was repeated in the same manner as described except that as the unexpanded particles a mixture of (1) 70 parts of unexpanded particles of an ethylene-propylene random copolymer having an ethylene content of 2.8% and n-heptane insoluble content of 30% and (2) 30 parts of unexpanded particles of a high density polyethylene having a density of 0.954 g/cm$^3$ and a melt index of 2 was used and that dichlorodifluoromethane was used in an amount of 20 parts, thereby obtaining a molded product having a density of 0.019 g/cm$^3$ and a gel fraction of 33.

COMPARATIVE EXAMPLE 3

Example 5 was repeated in the same manner as described except that dichlorodifluoromethane was used in an amount of 16 parts, thereby obtaining a molded product having a density of 0.029 g/cm$^3$ and a gel fraction of 35.

COMPARATIVE EXAMPLE 4

The crosslinked, pre-expanded particles obtained in Comparative Example 3 were placed in a vessel and held in the atmosphere of pressurized air so that the pressure within the cells of the pre-expanded particles rose to 3 Kg/cm$^2$G. The resulting particles were then heated with steam of 1.3 Kg/cm$^2$G for the further expansion thereof, whereby secondarily pre-expanded particles with a bulk density of 0.01 g/cm$^3$ were obtained. The secondarily preexpanded particles were then subjected to expansion molding in the same manner as in Comparative Example 3, thereby obtaining a molded product having a density of 0.011 g/cm$^3$ and a gel fraction of 35.

COMPARATIVE EXAMPLE 5

Comparative Example 4 was repeated in the same manner as described except that dichlorodifluoromethane was used in an amount of 25 parts, thereby obtaining a molded product having a density of 0.030 g/cm$^3$ and a gel fraction of 35.

COMPARATIVE EXAMPLE 6

The crosslinked, pre-expanded particles obtained in Example 7 were placed in a vessel and held in an atmosphere of pressurized air so that the pressure within the cells of the pre-expanded particles rose to about 2 Kg/cm$^2$G. The resulting particles were then heated with steam of 1.5 Kg/cm$^2$G for the further expansion thereof, whereby secondarily pre-expanded particles having a bulk density of 0.01 g/cm$^3$ were obtained. The secondarily pre-expanded particles were then subjected to expansion molding in the same manner as in Example 7, thereby obtaining a molded product having a density of 0.011 g/cm$^3$ and a gel fraction of 35.

EXAMPLE 12

Figure 6:
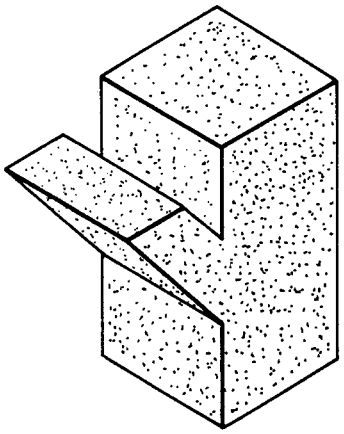
FIG. 6 is a perspective view of a pattern used for the fabrication of castings of Example 12 and Comparative Example 7.

A pattern having a shape as shown in FIG. 6 was prepared using each of the molded products obtained in Examples 1–3. Each pattern was coated with a suitable moldwash and embedded in a mold body formed of furan bonded sand together with a gating system. A molten metal charge was then poured into each sprue to obtain a casting which in shape was an exact replica of the pattern. As the molten metal charge, molten cast iron having a temperature of 1350° C. and containing 3.24% of carbon, 2.7% of silicon, 0.65% of manganese, and the balance being essentially iron was used in the case of using the patterns from Examples 1 and 3, while molten cast steel having a temperature of 1530° C. and containing 0.18% of carbon, 0.40% of silicon, 0.70% of manganese and the balance being essentially iron was used in the case of using the pattern from Example 2. A MgO moldwash was used in the casting of cast iron, while a zircon moldwash was employed in the casting of cast steel. A blind riser with a diameter of 50 mm and a height of 50 mm was provided in the mold body in the case of the production of cast steel castings. The thus obtained castings were then tested for their quality and were found to contain no carbon residues, to have no surface defects such as wrinkles, roughness and blow holes or no inside defects such as blow holes and carburization and to be identical in shape and size with the pattern used.

COMPARATIVE EXAMPLE 7

Example 12 was performed in the same manner as described using the pattern made from the molded products obtained in Comparative Examples 1 and 2. The casting obtained with the use of the pattern from Comparative Example 1 and the molten cast iron charge was found not to be identical with the pattern in both shape and size. The casting obtained with the use of the pattern from Comparative Example 2 and the molten case steel charge was found to contain surface and inside defects.

EXAMPLE 13

Figure 7:
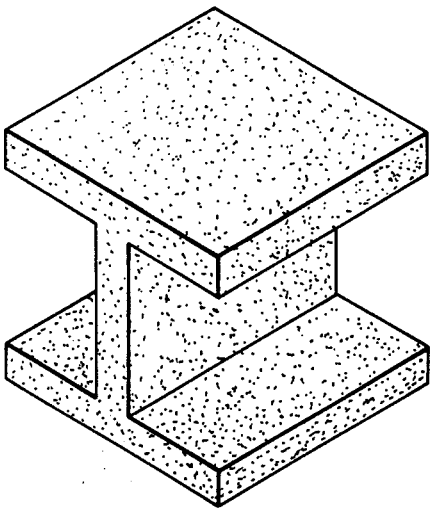
FIG. 7 is a perspective view of a pattern used for the fabrication of castings of Example 13 and Comparative Example 8.

A pattern having a shape as shown in FIG. 7 was prepared using each of the molded products obtained in Examples 4–11. Using these patterns, castings of cast iron or cast steel were prepared in the same manner as Example 12. Molten cast iron charge was used in the case of employing the patterns from Examples 4, 5, 7, 9 and 10, while molten cast steel charge was used in the case of employing the patterns from Examples 6, 8 and 11. The castings thus obtained were found to contain no carbon residues, to have no surface or inside defects and to be identical in shape and size with the pattern used.

COMPARATIVE EXAMPLE 8

Example 13 was performed in the same manner as described using the pattern made from the molded products obtained in Comparative Examples 3–6. The castings obtained with the use of the patterns from Comparative Examples 3 and 5 and the molten cast iron charge were found to have surface and inside defects. The castings obtained with the use of the patterns from Comparative Examples 4 and 6 and the molten cast steel charge were found not to be identical in shape and in size with the pattern.

EXAMPLE 14

Casting was conducted using the mold shown in FIG. 1. A pattern 15 formed of expanded, crosslinked ethylene-propylene random copolymer and having a density of 0.022 g/cm$^3$ and a size of 200 mm×200 mm×200 mm was bonded with ingate and runner forms 14 and 13 made of the same expanded resin as the pattern using a vinyl acetate resin adhesive. The resulting pattern was coated with a graphite moldwash having a poor air-permeability and placed in a flask 17. After providing an earthen sprue 12 and a wooden vent form 16, furan bonded sand (AFS 45-50) was filled in the flask 17 for packing the pattern 15 and its associated fittings in position, followed by the withdrawal of the wooden form 16, thereby obtaining a mold as shown in FIG. 1. A molten cast iron charge containing 3.6% of carbon, 2.7% of silicon, 0.4% of manganese, 0.045% of magnesium and the balance being essentially iron was then poured into the sprue 12 to effect casting. No blow phenomenon was observed and the casting thus obtained had no surface and inside defects.

EXAMPLE 15

Example 14 was repeated in the same manner as described except that the crosslinked ethylene-propylene random copolymer pattern used had a density of 0.025 g/cm$^3$ and the molten metal charge used was molten cast steel containing 0.16% of carbon, 0.31% of silicon, 0.65% of manganese and the balance being essentially iron. Almost no carburization was detected within the casting.

COMPARATIVE EXAMPLE 9

Example 15 was repeated in the same manner as described except that the pattern used was made of an expanded polystyrene resin having a density of 0.018 g/cm$^3$. Carburization was found to occur in the resulting casting.

EXAMPLE 16

Casting was carried out using the mold shown in FIGS. 2–4. A pattern 15 formed of expanded, non-crosslinked ethylene-propylene random copolymer and having a density of 0.024 g/cm$^3$ and a size of 200 mm×200 mm×200 mm was bonded with a pair of ingates 14 (30 mm×15 mm in cross-section) and a runner 13 (30 mm×30 mm in cross-section) made of the same expanded resin as the pattern 15 using a vinyl acetate resin adhesive and was placed in a flask 17 together with an earthen pipe 12 (diameter: 30 mm) as a sprue and forms (diameter: 5 mm) for vents 16, 16' and 16'', followed by surrounding with furan bonded sand (AFS 55). After the molding sand was set, the forms were removed to obtain a mold as shown in FIGS. 2–4. The inclination angles $\alpha$ and $\alpha'$ of the vents 16' and 16'' were 30° and 25° , respectively. The vents 16'' were located with a space therebetween of 40 mm. A molten cast iron charge containing 3.4% of carbon, 2.2% of silicon, 0.7% of manganese and the balance being essentially iron was then poured into the sprue 12. No blow phenomenon was observed and the casting thus obtained had no surface or inside defects.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A method of casting, comprising the steps of:

providing a pattern formed of an expanded polyolefin resin and having a bulk density of 0.025–0.012 g/cm$^3$, said polyolefin resin being selected from the group consisting of (a) non-crosslinked polypropylene resins which are ethylene-propylene random copolymers having an ethylene content of 0.5–10% by weight and having secondary crystals, (b) crosslinked polypropylene resins which are ethylene-propylene random copolymers having an ethylene content of 1–10% by weight, (c) crosslinked high density polyethylenes having a density of 0.94 g/cm$^3$ or more and (d) mixtures thereof;

embedding said pattern in a mold body;

forming in said mold body a gating system leading to said embedded pattern; and pouring in said gating system molten metal for volatizing and replacing said embedded pattern in said mold body.

2. A method as claim in claim 1, wherein said polyolefin resin is selected from the polypropylene resins and said pattern has a cell size of 0.1–1.0 mm.

3. A method as claimed in claim 1, wherein said crosslinked polypropylene resin has a n-heptane insoluble content of 50% or less.

4. A method as claimed in claim 1, wherein said crosslinked polypropylene resin and said high density polyethylenes have a gel fraction of 0.01–40%.

5. A method as claimed in claim 1, wherein said expanded polyolefin is produced by a process comprising the steps of providing particles of the polyolefin resin, expanding said particles to obtain pre-expanded particles, and heating said preexpanded particles within a mold to provide said expanded polyolefin.

6. A method as claimed in claim 1, further comprising forming in said mold body one or more vent passages leading to said embedded pattern so that the gas produced by the volatilization of said pattern may be discharged through said vent passage or passages to the air.

7. A method as claimed in claim 6, wherein at least one of said vent passages extends vertically from a top portion of said pattern and opens at the top of said mold body.

8. A method as claimed in claim 6, wherein said gating system includes an ingate formed of said expanded polyolefin resin and bonded to a lower portion of said pattern, a runner formed of said polyolefin resin and bonded to said ingate, and a sprue leading to said runner and opening at the top of said mold body, so that said runner and ingate are volatilized upon contact with the molten metal to allow the molten metal to contact said pattern in said mold body.

9. A method as claimed in claim 8, further comprising forming at least one vent hole leading to said runner.

10. A method as claimed in claim 9, wherein said vent hole is oriented slantwise and opens at the side periphery of said mold body.

* * * * *